US009677839B1

(12) United States Patent
Phoenix

(10) Patent No.: US 9,677,839 B1
(45) Date of Patent: Jun. 13, 2017

(54) FIREARM SUPPRESSOR AND METHODS OF MANUFACTURING THE SAME

(71) Applicant: Joseph Phoenix, Centralia, IL (US)

(72) Inventor: Joseph Phoenix, Centralia, IL (US)

(73) Assignee: Joseph Phoenix, Centralia, IL (US)

( * ) Notice: Subject to any disclaimer, the term of this patent is extended or adjusted under 35 U.S.C. 154(b) by 0 days.

(21) Appl. No.: 15/184,452

(22) Filed: Jun. 16, 2016

(51) Int. Cl.
*F41A 21/30* (2006.01)
*G10K 11/16* (2006.01)

(52) U.S. Cl.
CPC ..... *F41A 21/30* (2013.01); *G10K 11/16* (2013.01)

(58) Field of Classification Search
CPC ..... G10K 11/16; F41A 21/30
USPC ..... 181/223; 89/14.4
See application file for complete search history.

(56) References Cited

U.S. PATENT DOCUMENTS 5,164,535 A * 11/1992 Leasure ..... F41A 21/30 181/223
7,308,967 B1 * 12/2007 Hoel ..... F41A 21/30 181/223
7,661,349 B1 2/2010 Brittingham
7,856,914 B2 * 12/2010 Shults ..... F41A 21/30 181/223
7,987,944 B1 8/2011 Brittingham et al.
8,307,946 B1 * 11/2012 Johnston ..... F41A 21/30 181/223
8,424,635 B1 * 4/2013 Klawunn ..... F41A 21/30 181/223
8,459,405 B1 * 6/2013 Dueck ..... F41A 21/30 181/223
8,511,425 B2 8/2013 Larue
8,739,922 B2 6/2014 Wirth et al.
8,950,310 B2 2/2015 Storrs et al.
8,991,552 B2 3/2015 Latka
9,038,771 B1 5/2015 Mueller
9,182,188 B2 11/2015 Gawencki
9,482,484 B2 * 11/2016 Barney ..... F41A 21/30
2003/0145718 A1 * 8/2003 Hausken ..... F41A 21/30 89/14.4
2006/0123983 A1 * 6/2006 Vais ..... F41A 21/30 89/14.3
2011/0297477 A1 * 12/2011 Koumbis ..... F41A 21/325 181/223
2013/0312592 A1 11/2013 Storrs et al.
2015/0136519 A1 5/2015 Moore
2015/0260473 A1 * 9/2015 Barney ..... F41A 21/30 89/14.4

* cited by examiner

*Primary Examiner* — Forrest M Phillips
(74) *Attorney, Agent, or Firm* — Stinson Leonard Street LLP

(57) ABSTRACT

A suppressor assembly for reducing noise from a ballistic fired from a firearm muzzle is provided. The suppressor assembly includes an inlet cap having a cap inlet end, a cap outlet end, and a cap body extending therebetween. A baffle assembly is integrally coupled to the inlet cap, wherein the baffle assembly includes a baffle inlet end, a baffle outlet end, and a body extending continuously therebetween. An outlet cap is removably coupled to the baffle outlet end and includes another cap inlet end, another cap outlet end, and another cap body extending therebetween. The suppressor assembly includes a housing removably and pressurably coupled to the inlet cap and to the outlet cap.

7 Claims, 8 Drawing Sheets

FIREARM SUPPRESSOR AND METHODS OF MANUFACTURING THE SAME

BACKGROUND

The field of the disclosure relates generally to systems and methods for suppressing noise, and more particularly, to systems and methods for suppressing noise of a fired weapon.

Suppressors for firearms, also known as silencers, generally operate to reduce the audible noise or sharp report of a firing weapon by means of reducing and controlling the energy level of attendant propellant gases. Generally, the techniques include the provision of a series of baffles which control and delay the flow, expansion, and discharge of propellant gases, forcing the propellant gases to pass through various temperature absorbent materials to reduce the temperature and abrupt discharge of propellant gases. The result achieved is a corresponding reduction in the noise produced by the discharged propellant gases.

Known silencers for firearms can be generally classified into two groups. In one group, the discharge and propellant gases that follow the bullet into the silencer are stored for a short period of time in a plurality of successive chambers which are closed to the outside environment. This produces a controlled expansion of the propellant gases through each chamber, thereby reducing their temperature and pressure. In a second group, at least a portion of the propellant gases are diverted to exterior coaxial chambers through a plurality of passages between inner and outer walls. Although such arrangements can be complex, these arrangements can provide more capacity to delay and cool the gases, and hence reduce the sound level.

For typical suppressors, it may become difficult to remove the suppressor from the suppressor housing for cleaning. Tough residue from the discharge gases can build up quickly in and around crevices, creating a bond between the suppressor components which can be difficult to break. Moreover, baffles closer to the muzzle end of the firearm are subjected to greater pressure, contaminants, and heat from the firearm flash during discharge, than baffles located further away from the muzzle end, thereby causing premature wear and failure of the suppressor. Additionally, during discharge, typical suppressors may experience a "baffle strike' wherein the ballistic strikes the baffle. Baffle strikes can further damage the suppressor which can increase component failure, noise and/or flash.

Another disadvantage of current firearm suppressor use is the problem of suppressor instability that results from the use of a threaded connection of the suppressor to the barrel of a firearm. The barrel of a firearm that is designed for attachment of a suppressor is typically provided with a reduced diameter externally threaded section that is of fairly short length. An internally threaded section of a typical suppressor is fairly short, thus causing the threaded connection to have minimal stability due to the typical length of the threaded connection of the suppressor with the firearm barrel.

It is desirable to provide a suppressor which is conveniently and efficiently assemble to and disassemble from the firearm for convenient cleaning and maintenance. Additionally, it is desirable to provide a suppressor that eliminates or reduces baffle strike from the discharged ballistic. It is also desirable to provide a suppressor that is exceptionally stable as well as protecting the internal components from the undesirable characteristics of gunpowder residue buildup and fouling. Moreover, it is desirable to provide a suppressor that further suppresses noise and flash discharge.

BRIEF SUMMARY

In one aspect, a suppressor assembly for reducing noise from a ballistic fired from a firearm muzzle is provided. The suppressor assembly includes an inlet cap having a cap inlet end, a cap outlet end, and a cap body extending therebetween. A baffle assembly is integrally coupled to the inlet cap, wherein the baffle assembly includes a baffle inlet end, a baffle outlet end, and a body extending continuously therebetween. An outlet cap is removably coupled to the baffle outlet end and includes another cap inlet end, another cap outlet end, and another cap body extending therebetween. The suppressor assembly includes a housing removably and pressurably coupled to the inlet cap and to the outlet cap, the housing comprises a housing inlet end, a housing outlet end, and a housing body extending therebetween, wherein the housing inlet end includes an internal housing fastener configured to removably and pressurably couple to the external fastener of the cap inlet end of the inlet cap and the housing outlet end includes another internal housing fastener configured to removably and pressurably couple to the outlet cap.

In another aspect, a suppressor assembly for reducing noise created by a ballistic fired from a firearm muzzle is provided. The suppressor assembly includes an inlet cap comprising a cap inlet end, a cap outlet end, and a cap body extending therebetween. A baffle integrally is coupled to the cap outlet end, the baffle assembly comprises a baffle inlet end, a baffle outlet end, and a cylindrical body continuously extending therebetween and about a longitudinal axis of the baffle assembly. The cylindrical body includes a plurality of first openings sequentially arranged along the cylindrical body and in a first alternating pattern relative to a first side portion and an opposing second side portion of the longitudinal axis. A plurality of second openings is sequentially arranged along the cylindrical body and in a second alternating pattern relative to an upper portion and a lower portion of the longitudinal axis. A housing is removably and pressurably coupled to the cap inlet end and to the baffle outlet end wherein the housing surrounds the cap body and the cylindrical body.

BRIEF DESCRIPTION OF THE DRAWINGS

Features, aspects, and advantages of the present disclosure will become better understood when the following Detailed Description is read with reference to the accompanying drawings in which like characters represent like parts throughout, wherein.

DETAILED DESCRIPTION

The embodiments described herein relate to suppressing noise and flash from a discharged firearm. Moreover, the embodiments described herein relate to a suppressor assembly that facilitates efficient assembly and disassembly for convenient cleaning, part replacement, and maintenance. Additionally, the embodiments described herein facilitate increasing stability for the suppressor assembly while protecting internal components from undesirable characteristics of gunpowder residue buildup and fouling. Furthermore, the embodiments relate to eliminating or reducing "baffle strikes" by the discharged ballistic. The embodiments relate to a suppressor assembly that is efficient and cost effective to design, build, operate, and maintain. The exemplary suppressor assembly can be used with and for any type of firearm.

Figure 1:
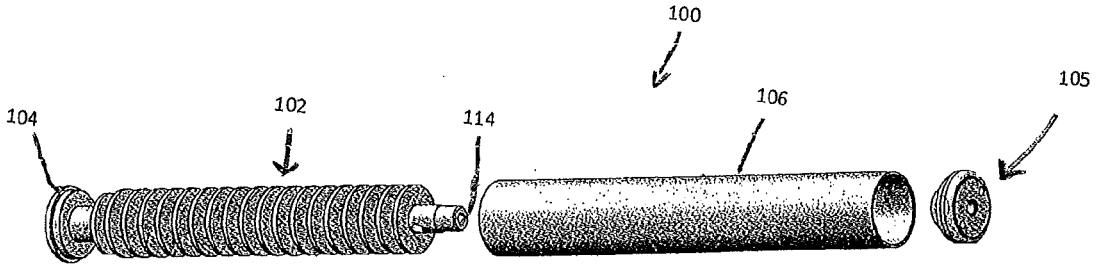
FIG. 1 is an exploded view of an exemplary suppressor assembly showing a baffle assembly, an inlet cap, an outlet cap, and a housing.
Figure 1A:
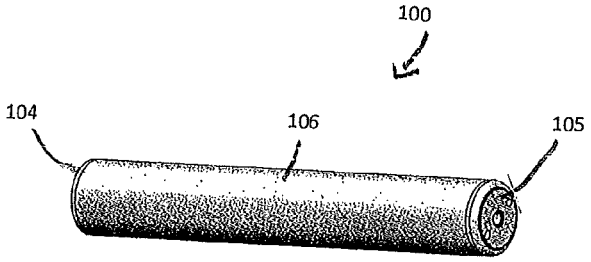
FIG. 1*a* is a perspective view of the assembled suppressor assembly shown in FIG. 1.

FIG. 1 is an exploded view of a suppressor assembly 100 that includes a baffle assembly 102, an inlet cap 104, an outlet cap 105, and a housing 106. FIG. 1*a* is a perspective view of the assembled suppressor assembly 100. The suppressor assembly 100 is configured to removably couple to a muzzle end of a firearm barrel (neither shown). The suppressor assembly 100 can be adapted for any type of firearm, including but not limited to, large and small caliber rifles, handguns, single-shot, semi-automatic and fully automatic guns, bolt-action rifles, shotguns, rim-fire, and center-fire guns. Moreover, each of the baffle assembly 102, the inlet cap 104, the outlet cap 105, and the housing 106 can include a plurality of material compositions such as, for example, steel, titanium, aluminum, ceramic, and composites. Additionally, the suppressor assembly 100 may use coatings in aiding resistance to wear and for thermodynamic performance considerations of the suppressor assembly 100. For example, in some embodiments, a high temperature ceramic coating of low thermodynamic transmission properties may be used to limit heat degradation and particle impingement wear in the baffle assembly 102, the inlet cap 104, the outlet cap 105, and the housing 106. In another embodiment, a high temperature ceramic coating of high heat dissipative properties may be used to assist in thermal heat dissipation to the atmosphere and the limitation of particle impingement wear in the baffle assembly 102, the inlet cap 104, the outlet cap 105, and the housing 106.

Figure 2:
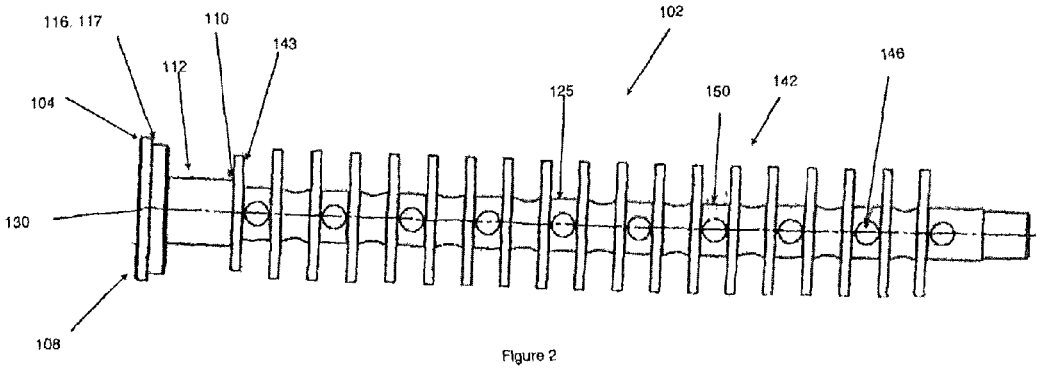
FIG. 2 is a side view of the baffle assembly and the inlet cap of FIG. 1.
Figure 3:
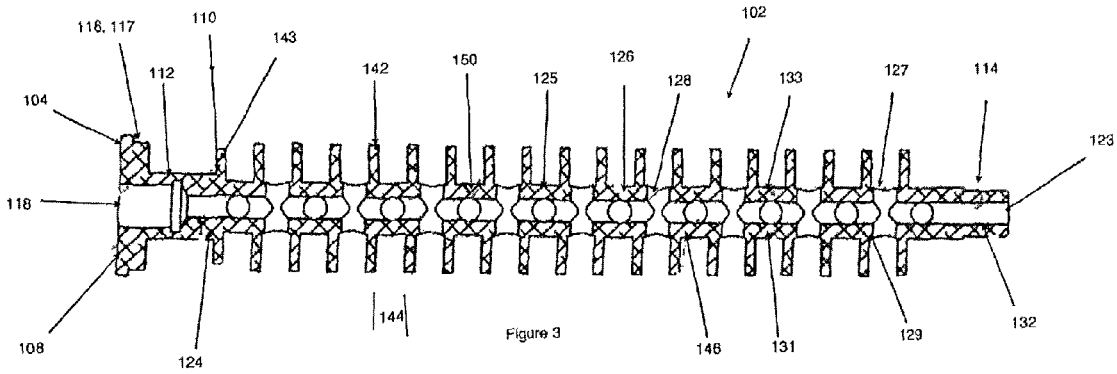
FIG. 3 is a cross sectional view of the baffle assembly and the inlet cap of FIG. 2.
Figure 4:
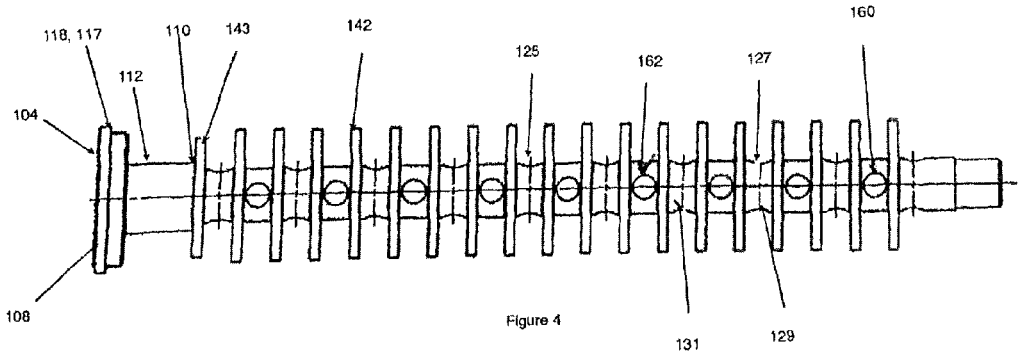
FIG. 4 is a top view of the baffle assembly and the inlet cap of FIG. 2.

FIG. 2 is a side view of the baffle assembly 102 and the inlet cap 104 of FIG. 1. FIG. 3 is a cross sectional view of the baffle assembly 102 and the inlet cap 104. FIG. 4 is a top view of the baffle assembly 102 and the inlet cap 104. The inlet cap 104 includes a cap inlet end 108, a cap outlet end 110, and a cap body 112 extending there between. As measured between the cap inlet end 108 and the cap outlet end 110, the inlet cap 104 has a length from about 0.5 inches inch to about 12 inches. In the exemplary embodiment, the inlet cap 104 has a length of about 1.10 inches. The length of the inlet cap 104 facilitates convenient and efficient spacing of the baffle assembly 102 relative to the firearm. Additionally, the length of the inlet cap 104 is configured to facilitate cooling of discharged gases to reduce noise and/or flash of the discharged firearm. The length of the inlet cap 104 facilitates increasing the stability of the suppressor assembly 100 coupled to the firearm. The inlet cap 104 defines a ballistic pathway 114 through the cap inlet end 108, the cap body 112, and the cap outlet end 110. The ballistic pathway 114 is sized and shaped to accommodate for a selective bore or gauge size of a ballistic (not shown). In the exemplary embodiment, the ballistic pathway 114 includes an inner diameter of about 15⁄64 inches. Alternatively, the ballistic pathway 114 can include any sized diameter selectively based on the ballistic size.

The cap inlet end 108 includes an external fastener 116 and an internal fastener 118. In the exemplary embodiment, the external fastener 116 includes a flange 117. The cap inlet end 108 includes a larger outer diameter than the cap body 112 to facilitate forming the flange 117. In the exemplary embodiment, the cap inlet end 108 includes an outer diameter from about 0.5 inches to about 2.5 inches; and, preferably has an outer diameter of about 1.5 inches to form a planar face surface for the flange 117. The cap body 112 has an outer diameter from about 1 inch to about 2 inches; and, preferably has an outer diameter of about 1.365 inches. The external fastener 116 is configured to removably couple to the housing 106 as described herein. The internal fastener 118 can include a female thread, which is configured to removably and selectively couple to a muzzle end of a firearm (not shown). For example, the internal fastener 118 is configured to removably receive the complementary male threads (not shown) on the muzzle of the firearm. Alternatively, other fasteners such as, but not limited to, quick disconnect couplings and/or pins can be used to removably couple the cap inlet end 108 to the firearm.

The cap outlet end 110 is configured to removably couple to the baffle assembly 102 as described herein. In the exemplary embodiment, the cap outlet end 110 is integrally coupled to the baffle assembly 102. More particularly, the baffle assembly 102 and the inlet cap 104 are machined from the same piece of material. Alternatively, the baffle assembly 102 and the inlet cap 104 can be welded together. Alternatively, the cap outlet end 110 can be removably coupled to the baffle assembly 102 by a fastener (not shown), such as but not limited to, threaded fasteners.

The one-piece, machined construction of the baffle assembly 102 and the inlet cap 104 facilitates stabilizing the suppressor assembly 102 by at least one of providing a continuous material composition through the baffle assembly 102 and the inlet cap 104; providing uniform tolerances through the baffle assembly 02 and the inlet cap 104; and, providing efficient manufacturing of the baffle assembly 102 and in the inlet cap 104. Additionally, the one-piece, machined construction of the baffle assembly 102 and the inlet cap 104 facilitates cooling of discharged gases to reduce noise and/or flash of the discharged firearm by providing at least a uniform construction and material composition of the ballistic pathway 114.

The baffle assembly 102 is configured to removably couple to the outlet cap 105. Alternatively, the baffle assembly 102 can be integrally coupled to the outlet cap 105. The baffle assembly 102 includes a baffle inlet end 124, a baffle outlet end 123, and a body 125 extending between the baffle inlet end 124 and the baffle outlet end 123. In the exemplary embodiment, the body 125 is cylindrically-shaped and continuously extends between the baffle inlet end 124 and the baffle outlet end 123. More particularly, the baffle assembly 102 is formed from the same piece of material. Alternatively, the body 125 can include other non-cylindrical shapes, as measured between the baffle inlet end 124 and the baffle outlet end 123. The baffle assembly 102 has a length from about 1 inch to about 20 inches. In the exemplary embodiment, the baffle assembly 102 has a length of about 10½ inches. The length of the baffle assembly 102 is configured to facilitate convenient and efficient assembly to and disassembly from the housing 106. Moreover, the length of the baffle assembly 102 is configured to reduce noise and/or flash from the discharged ballistic. Alternatively, the baffle assembly 102 can include other lengths and other configurations.

In the exemplary embodiment, the body 125 includes an outer wall 126 and an inner wall 128. The inner wall 128 is configured to further define the ballistic pathway 114 within the body 125 and about a longitudinal axis 130 of the baffle assembly 102. The baffle outlet end 123 includes an external fastener 132 configured to removably couple to the outlet cap 105 as described herein. As shown, relative to the longitudinal axis 130, the body 125 includes an upper portion 127, a lower portion 129, a side portion 131, and an opposing side portion 133.

The baffle assembly 102 includes a plurality of baffles 142 coupled to the body 125. In the exemplary embodiment, the plurality of baffles 142 is configured to radially extend outward from the body 125. Moreover, in the exemplary embodiment, the baffles 142 radially extend outward and are substantially perpendicular to the longitudinal axis 130. Alternatively, the plurality of baffles 142 can extend at any angular orientation relative to the longitudinal axis 130. Each baffle 142 includes a circular configuration having outer diameter from about 0.5 inches to about 2 inches; and, preferably has an outer diameter of about 1.5 inches. Each baffle further includes a width from about 0.05 inches to about 0.5 inches; and, preferably has a width of about 0.10 inches. Alternatively, the baffles 142 can include other shapes such, for example only, a pyramid shape and a wafer shape.

In the exemplary embodiment, a first baffle 143 is positioned between the outlet end 110 of the inlet cap 104 and the baffles 142. The first baffle 143 includes an outer diameter having a different size than the outer diameters of the other baffles 142. More particularly, the outer diameter of the first baffle 143 is less than the outer diameters of the other baffles 142. The smaller size of the first baffle 143 facilitates receiving a backflow of the discharge gas of the fired ballistic to facilitate gas pressure expansion to reduce noise and/or flash of the discharge ballistic. Alternatively, the first baffle 143 can include a larger diameter as compared to the plurality of baffles 142.

The plurality of baffles 142 is selectively coupled to the outer wall 126. In an embodiment, the baffles 142 are permanently coupled to the outer wall 126 such as by lathing or cutting or welding or other machining processes. More particularly, the baffles 142 are machined from the same piece of material as the body 125. In another embodiment, the baffles 142 are removably coupled to the outer wall 126 by sliding the baffles 142 along the outer wall 126 and threading to the outer wall 126. Pairs of adjacent baffles 142 are selectively arranged on the outer wall 126 to define a baffle chamber 144 between the pair of baffles 142. Each baffle chamber 144 includes a length as measured between adjacent baffles 142 from about ⅛ inch to about 1 inch; and, preferably has a length of about 5/16 inch. The selective sizes and shapes of the baffles 142 facilitate reducing noise and/or flash of the discharge firearm.

The shape of the body 125 is configured to eliminate or reduce baffle strikes. In the exemplary embodiment, if the ballistic hits or contacts the inner wall 128, the inner wall 128 is configured to direct the ballistic through the ballistic pathway 114 and away from the baffles 142. Additionally, the body 125 includes a plurality of first openings 146 defined through the outer wall 126 and the inner wall 128 and in flow communication with the ballistic pathway 114. The plurality of first openings 146 is selectively and sequentially arranged along the body 125. In an embodiment, the plurality of first openings 146 is arranged in a first alternating pattern 150 relative to the side portion 131 and the other side portion 133. More particularly, the plurality of first openings 146 are positioned in alternating sequence relative to the baffle chambers 142 and through the side portion 131 and the side portion of the body 133.

The body 125 further includes a plurality of second openings 160 defined through the outer wall 126 and the inner wall 128 and in flow communication with the ballistic pathway 114. The plurality of second openings 160 is sequentially arranged along the body 125 and in a second alternating pattern 162 relative to the upper portion 127 of the body 125 and the lower portion 129 of the body 125. More particularly, the plurality of second openings 160 are positioned in alternating sequence relative to the baffle chambers 142 and through the upper portion 127 and the lower portion 129 of the body 125.

The plurality of first openings 146 and the plurality of second openings 160 include a substantially circular shape within and through the body 125. The first openings 146 and the second openings 160 include an inner diameter from about 0.0625 inches to about 1 inch; and, preferably have an inner diameter of about 0.25 inches. Alternatively, the first openings 146 and the second openings 160 can include other shapes and sizes. The selective arrangements, patterns, and sizes of the first openings 146 and the second openings 160 are configured to facilitate reducing noise and flash created by discharged gases from the fired ballistic. The selective sizes and shapes of the openings 146, 160 facilitate reducing noise and/or flash of the discharge firearm.

Figure 5:
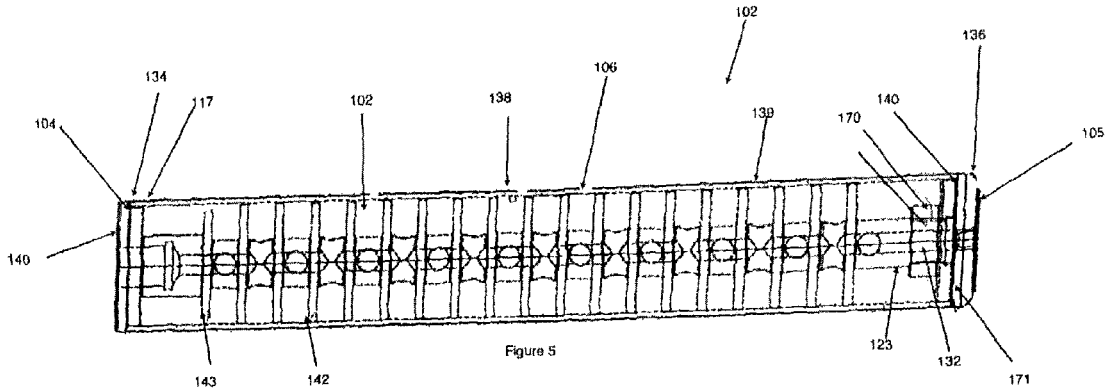
FIG. 5 is a side view of the baffle assembly and the caps positioned within the housing.
Figure 6:
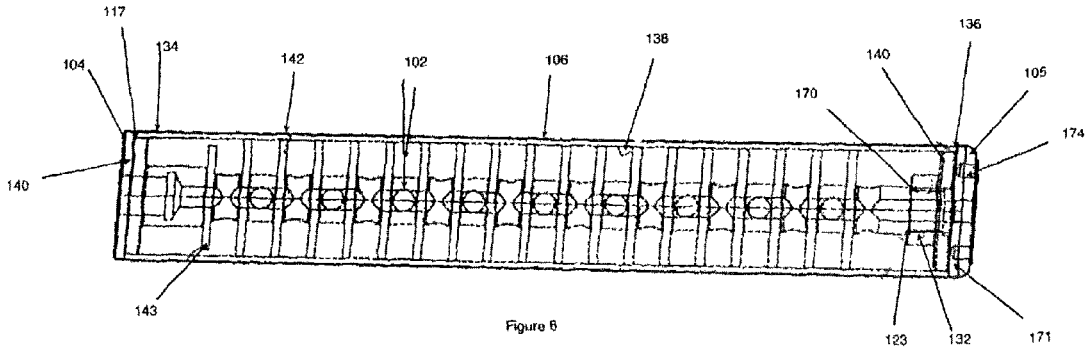
FIG. 6 is a top view of the baffle assembly and the caps positioned within the housing.
Figure 7:
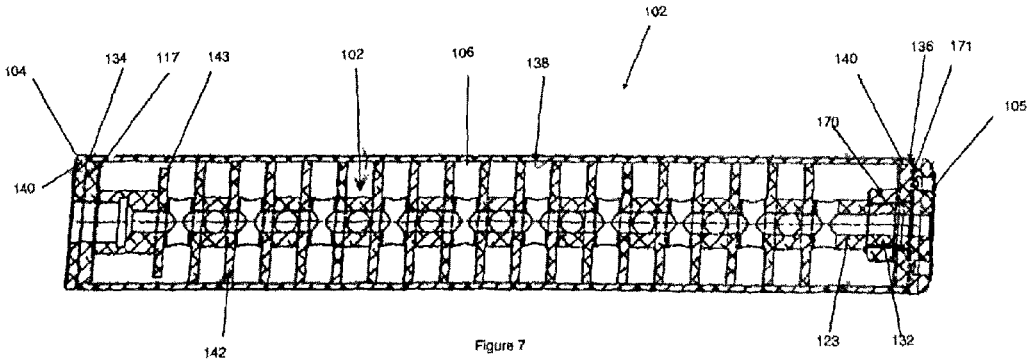
FIG. 7 is a cross sectional view of the suppressor assembly of FIG. 6.

FIG. 5 is a side view of the baffle assembly 102 and the caps 104, 105 positioned within the housing 106. FIG. 6 is a top of the baffle assembly 102 and caps 104, 105 positioned within the housing 106. FIG. 7 is a cross sectional view of the suppressor assembly 102. The housing 106 is configured to removably couple to the inlet cap 104, the outlet cap 105, and to the baffle assembly 102 to facilitate surrounding the baffle assembly 102. The housing 106 includes a housing inlet end 134, a housing outlet end 136, and a housing body 138 extending between the housing inlet end 134 and the housing outlet end 136. As measured between the housing inlet end 134 and the housing outlet end 136, the housing 106 has a length from about 1 inch to about 25 inches. In the exemplary embodiment, the housing 106 has a length of about 10½ inches. The length of the housing 106 is configured to facilitate convenient and efficient assembly to and disassembly from the inlet cap 104, the outlet cap 105, and the baffle assembly 102. The housing inlet end 134 includes an end wall 140 configured to removably couple to the planar face of the flange 117 of the inlet cap 104. The housing outlet end 136 includes another end wall 140 configured to removably couple to the planar face of a flange 171 of the outlet cap 105. The housing body 138 includes an indicia space 139 which includes an area to imprint a serial number (not shown).

Figure 8:
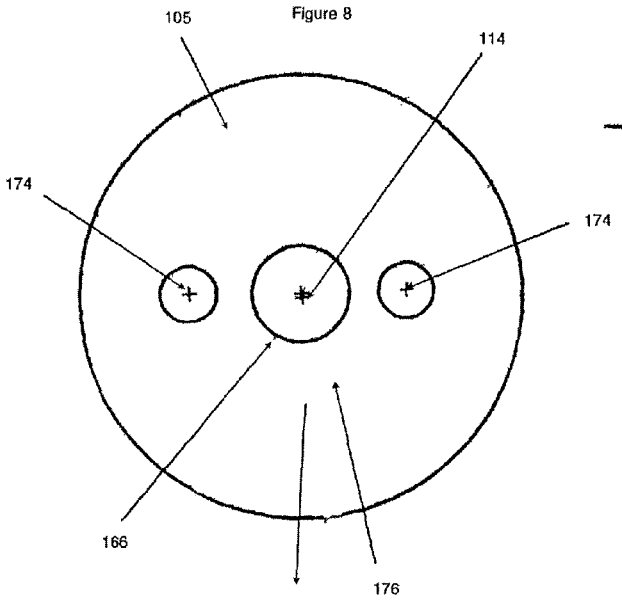
FIG. 8 is a front view of the outlet cap of FIG. 1.
Figure 9:
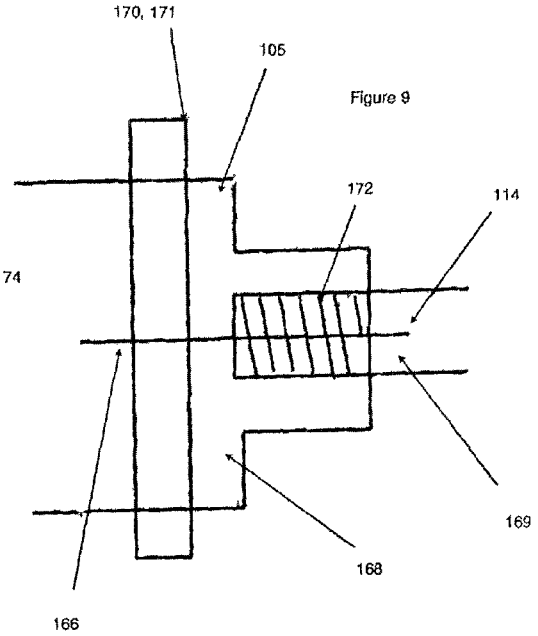
FIG. 9 is a cross sectional view of the outlet cap of FIG. 8.
Figure 10:
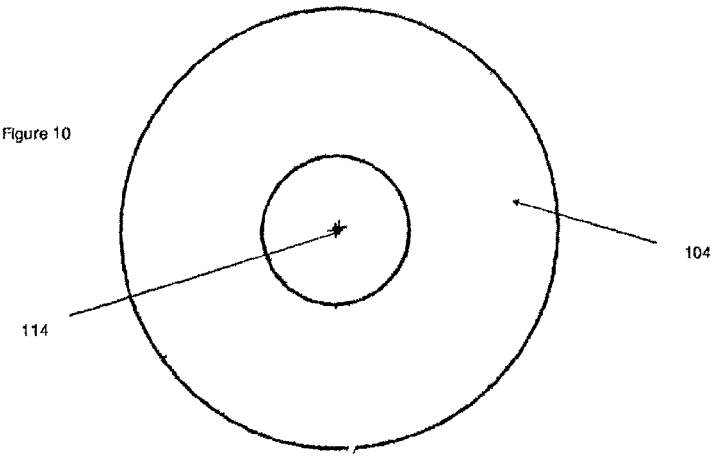
FIG. 10 is a front view on the inlet cap of FIG. 1.

FIG. 8 is a front view of the outlet cap 105 of FIG. 1. FIG. 9 is a cross sectional view of the outlet cap 105 of FIG. 8. FIG. 10 is front view of the inlet cap 104. The outlet cap 105 includes a cap inlet end 164, a cap outlet end 166 and a cap body 168 extending there between. As measured between the cap inlet end 164 and the cap outlet end 166, the outlet cap 105 has a length from about 0.5 inches inch to about 2 inches. In the exemplary embodiment, the outlet cap 105 has a length of about 0.75 inches. The length of the outlet cap 105 is configured to facilitate cooling of discharged gases to reduce noise and/or flash of the discharged firearm. Additionally, the length of the outlet cap 105 facilitates increasing the stability of the suppressor assembly 102. The outlet cap 105 further defines the ballistic pathway 114 through the cap inlet end 164, the cap body 168, and the cap outlet end 166. The cap outlet end 166 is configured to discharge the fired ballistic outward and beyond the suppressor assembly 102.

The cap inlet end 164 includes an external fastener 170 and an internal fastener 172. In the exemplary embodiment, the external fastener 170 includes the flange 171. The cap inlet end 166 includes a larger outer diameter than the cap body 168 to facilitate forming the flange 171. In the exemplary embodiment, the cap inlet end 166 includes an outer diameter from about 0.5 inches to about 2.5 inches; and, preferably has an outer diameter of about 1.5 inches. The cap body 168 has an outer diameter from about 1 inch to about 2 inches; and, preferably has an outer diameter of about 1.365 inches to form a planar face of the flange 171. The external fastener 170 is configured to removably couple to the housing 106 as described herein. The internal fastener 172 is configured to removably couple to the external fastener 132 of the baffle outlet end 123 (not shown). For example, the internal fastener 172 includes a female thread which is configured to removably receive the complementary male threads of the baffle outlet end 123. Alternatively, other fasteners such as, but not limited to, quick disconnect couplings and pins, can be used to removably couple the outlet cap 105 to the body 125.

The cap outlet end 166 includes a pair of holes 174 positioned opposite each other and spaced from the ballistic pathway 114. The holes 174 are configured to receive a wrench (not shown) for tightening the outlet cap 105 to the baffle outlet end 123. The cap outlet end 160 further includes an indicia area 176. The indicia area 176 is configured to receive indicia such as, but not limited to, an emblem, sticker, logo, and design.

The housing 106 is configured to slide over the baffle assembly 102 and toward the inlet cap end 104. More particularly, the housing inlet end 134 is configured to couple to the flange planar face 117 by, for example only, abutting up against and next to the flange planar face 117. The housing inlet end 134 is also configured to surround the cap outlet end 110 and the cap body 112. When the housing inlet end 134 is coupled to the inlet end cap 104, the housing body 138 is configured to surround the plurality baffles 142 including the first baffle 143. The inner diameter of the housing body 138 removably couples to the outer diameters of the baffles 142 to facilitate a snug, pressure, and/or tight fit of the housing body 138 around the baffles 142.

Furthermore, when the housing inlet end 134 is coupled to the inlet end cap 104, the housing outlet end 136 is configured to surround the baffle outlet end 123. The outlet cap 105 is configured to removably couple to the baffle end 123. More particularly, the internal fastener 170 of the cap outlet end 166 is configured to couple, for example thread, to the external fastener 132 of the baffle outlet end 123 to tighten the outlet cap 105 to the baffle outlet end 123. The housing outlet end 136 is configured to couple to the flange planar face 171 of the external fastener 170 of the outlet cap 105.

The housing outlet end 136 abuts up and against the flange planar face 171 and surrounds the cap body 168. In this position, the wrench is configured to removably couple to the holes 174 and to tighten, for example by turning, the cap body 168. The internal fastener 172 is configured to couple or mate with the external fastener of the baffle outlet end 123. Since the housing ends 134, 136 are positioned against the respective flanges 117, 171, the wrench is configured to pressurably tighten the outlet cap 105 against the housing 106. In response, the housing inlet end 134 is pressurably tightened against the cap outlet 110 of the inlet cap 104.

Accordingly, the tightening or movement of the outlet cap 105 against the housing 106 provides a compression fit of the inlet cap 104 and the outlet cap 105 against the housing 106. Moreover, to remove the housing 106, the wrench is applied and coupled to the holes 174 to the turn the outlet cap 105 in an opposite direction. This movement is configured to decouple the internal fastener 172 from the external fastener 132 of the baffle outlet end 123 to facilitate removing the pressure applied to the housing 106 by the inlet cap 104 and the outlet cap 105. The outlet cap 105 is conveniently and efficiently decoupled or disconnected from the body 125 to facilitate removal of the housing 106 to expose the baffles 142.

The pressurized assembly of the housing 106 to at least one of the baffle assembly 102, the inlet cap 104, and the outlet cap 105 facilitates efficient assembly and disassembly or convenient, quick, and efficient access to the baffle assembly 102 for cleaning, replacement, and/or maintenance purposes. Additionally, the pressurized assembly of the housing 106 to at least one of baffle assembly 102, the inlet cap 104, and the outlet cap 105 facilitates increasing stabilization for the suppressor assembly 100 while protecting at least the baffle assembly 102 from undesirable characteristics of gunpowder residue buildup and/or fouling. Moreover, the pressurized assembly of the housing 106 facilitates removal of the housing 106 from the baffle assembly 102 to conveniently, quickly, and efficiently replace different baffle assemblies 102 within the suppressor assembly 100.

In an exemplary method of manufacturing the suppressor assembly 100, the method includes forming the inlet cap 104. More particularly, the method includes forming the cap inlet end 108, the cap outlet end 110, and the cap body 112 by a fabrication process. The outlet cap 105 is formed; and in particular, the cap inlet end 164, the cap outlet end 166, and the outlet cap body 168 are formed by the fabrication process. The fabrication process can include processes such as, but not limited to, casting, forging, rolling, lathing, and threading.

In the exemplary method, the baffle assembly 102 is formed which includes forming the baffle inlet end 124, the baffle outlet end 123, and the body 125. The fabrication process for the baffle assembly 102 can include processes such as, but not limited to, cutting, casting, forging, welding, lathing, and threading. Moreover, in the exemplary method, the body 125 is continuously formed between the baffle inlet end 124 and the baffle outlet end 123. The body 125 is formed such that the inner wall is 128 formed about the longitudinal axis 130 of the baffle assembly 102 to facilitate forming the ballistic pathway 114.

The plurality of first openings 146 is formed into the body 125 and in flow communication with the ballistic pathway 114. Moreover, the plurality of first openings 146 is formed in the first alternating pattern 150 relative to the first side 156 and the second side 158 of the longitudinal axis 130. The plurality of first openings 146 is fabricated by processes such as, for example only, punching and cutting. The plurality of second openings 160 is formed into the cylindrical body 160 and in flow communication with the ballistic pathway 114. Moreover, the plurality of second openings 160 is formed in the second alternating pattern 162 relative to the first side 156 and the second side 158 of the longitudinal axis 130. The plurality of second openings 160 is formed by processes such as, for example only, punching and cutting.

The method includes forming the plurality of the baffles 142 continuously along the body 125. In the exemplary embodiment, the baffles 142 are formed along the outer wall 126 and radially extend outward from the outer wall 126 at about 90°. Alternatively in other methods, the baffles 142 can be formed radially extending outward from the outer wall 126 at any angular orientation. The plurality of baffles 142 is formed by processes such as, for example only, casting, forging, welding, and lathing. Alternatively, the baffles 142 can be slid along the outer wall of the body 125 and thread ably fastened thereto. In the exemplary method, the housing is formed 430 which includes forming the housing inlet end 134, the housing outlet end 136, and the housing body 138 there between. The housing 106 can be formed by fabrication processes such as, but not limited to, casting, forging, welding, and lathing.

During the assembly method, the baffle outlet end 123 is removably coupled 440 to the cap outlet end 166. In an embodiment, the baffle outlet end 123 is threaded to the cap outlet end 110. The baffle assembly 102 is moved or slid 550 inside the housing body 138. The housing 106 is removably coupled 560 to the cap outlet end 110 and the baffle assembly 102. In the exemplary method, the end wall 140 of the housing inlet end 134 is abutted against and coupled to the flange 117 of the cap inlet end 108. Moreover, the other end wall 140 of the housing outlet end 136 is abutted against and coupled to the flange 171 of the cap inlet end 164. In the assembled position, the housing 106 substantially surrounds the baffle assembly 102. In the exemplary method, the housing 106 conveniently and effectively removably couples to and from the baffle assembly 102, the inlet cap 104, and the outlet cap 105. Accordingly, during removal and/or replacement of the baffle assembly 102, the inlet cap 104, and/or outlet cap 105, the serial number can be maintained on the housing outer wall 126 of the indicia location.

During an exemplary operation, the cap inlet end 108 is configured to attach to the muzzle of a firearm such that the ballistic pathway 114 is substantially co-axial with the trajectory of the ballistic as it exits the muzzle of the firearm. When the ballistic exits the muzzle, it exits along with high velocity discharge gases that, in normal operation, exit the muzzle rapidly, which causes a loud noise and/or firearm. The suppressor assembly 100 is configured to dissipate the discharge gases that exit the muzzle of a firearm to reduce the level of noise and/or flash being emitted.

The suppressor assembly 100 facilitates reducing noise and/or flash by trapping the propellant gases from the firing of the ballistic inside the baffle assembly 102. As the trapped gas expands, migrates, and cools through the series of first openings 146, second openings 160, and/or baffle chambers 144, the pressure and velocity of the ballistic gases decrease by thermodynamic principles. The decrease of thermodynamic principles results in sound wave attenuation. The ballistic pathway 114 is aligned to the barrel bore to permit the passage of the ballistic through the ballistic pathway 114. The inner wall 128 is typically larger than the ballistic caliber to minimize the risk of "baffle strike" i.e. the ballistic contacting the inner wall 128. Since the body 125 extends continuously between the baffle outlet end 123 and the baffle inlet end 124, the ballistic travels with the ballistic pathway 114 entirely within the inner wall 128. Accordingly, the ballistic can strike the inner wall 128 but the body 125 eliminates the ballistic striking any baffle 142 to eliminate "baffle strike."

Figure 11:
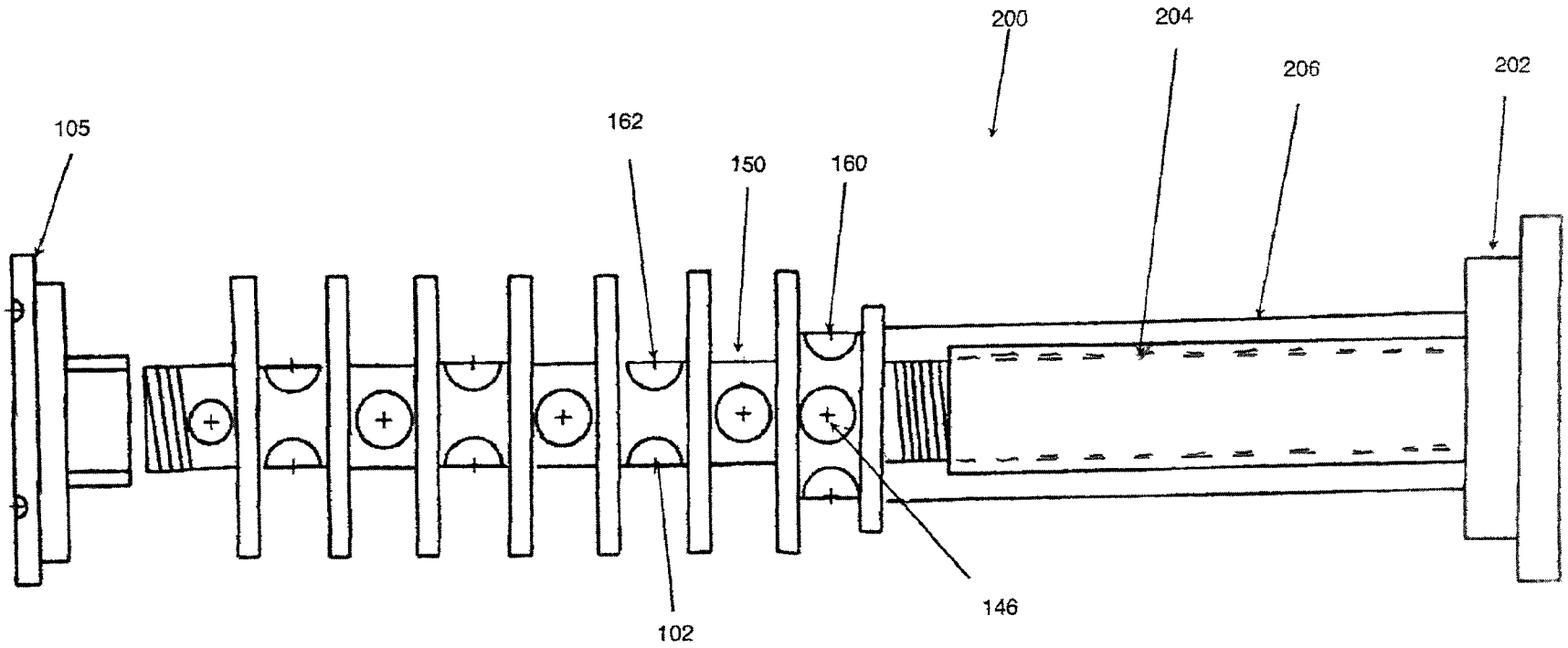
FIG. 11 is a side view of another exemplary suppressor assembly.

FIG. 11 is a side view of another exemplary suppressor assembly 200. In FIG. 11, same or similar components shown in FIGS. 1-10 include the same elements numbers as shown in FIGS. 1-10. In the exemplary embodiment, an inlet cap 202 is configured to receive a barrel end 204 of the firearm; and, the outlet cap 105 is removably coupled to the external fastener 132 of the baffle outlet end 123. In an embodiment, the baffle assembly 102 and the inlet cap 202 are formed from the same piece of material. The inner diameter of the ballistic pathway 114 of the inlet cap 202 is sized and shaped to slide over and around the barrel end 204 of the firearm barrel. In this "over-the-barrel" configuration, a cap body 206 has a different length than the cap body 112 of FIGS. 1-10. More particularly, the cap body 206 has a longer length than the cap body 112. The cap body 206 has a length as measured from the cap inlet end 108 and to the cap outlet end 110 from about 1 inch to about 10 inches; and preferably, about 5 inches.

By sliding over the firearm barrel, the suppressor assembly 200 extends outward from the firearm barrel at a lesser length as compared to the suppressor assembly 100 of FIG. 1. A smaller length can increase mobility in some hostile environments. The baffle assembly 102 includes the first plurality of openings 146 in the first alternating pattern 150. Moreover, the baffle assembly 102 includes the second plurality of openings 160 in the second alternating pattern 162. As illustrated in FIG. 11, within the baffle chamber 144 between the first baffle 143 and the plurality of baffles 142, there is at least one of the first opening 146 and second opening 160 defined through the body 125 and in flow communication with the ballistic pathway 114. The size and shape of the suppressor assembly 200 is configured to reduce noise and/or flash of the discharged firearm.

Figure 12:
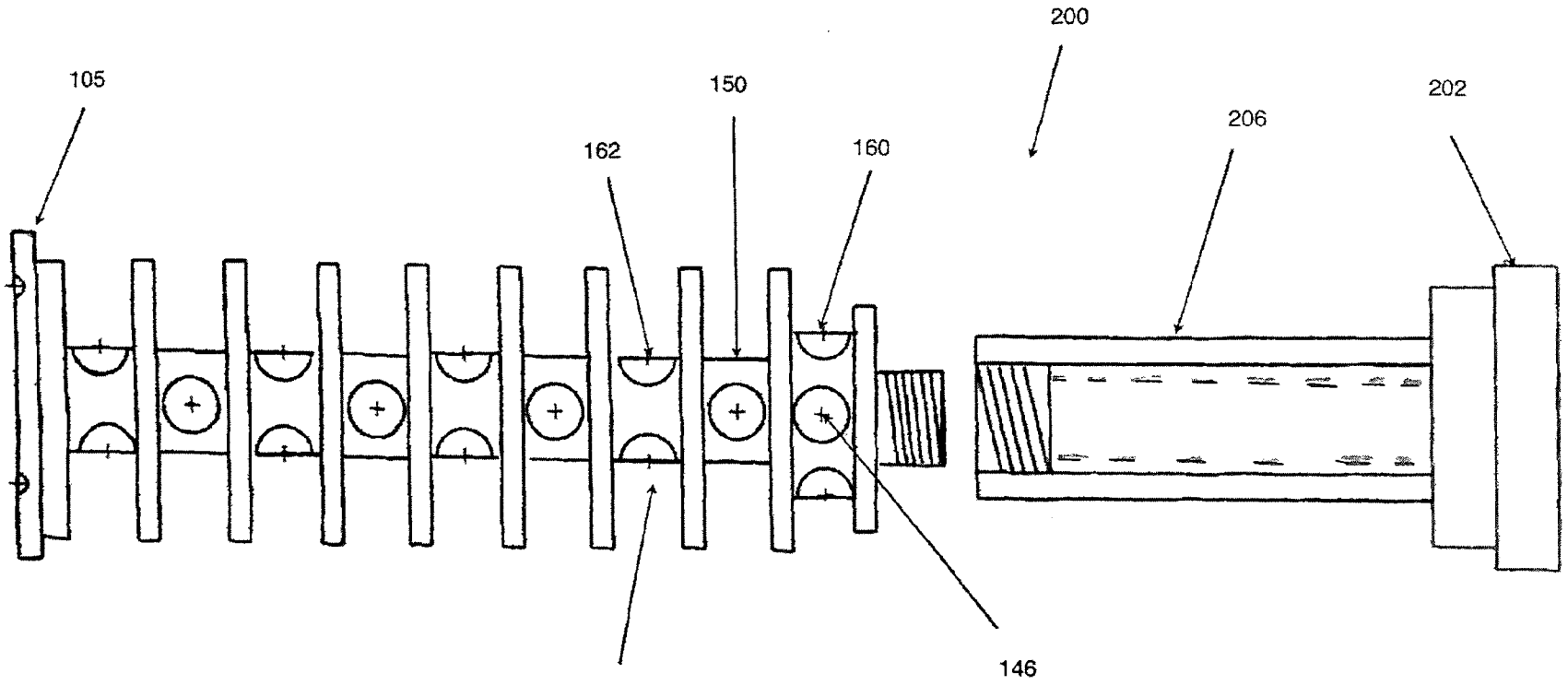
FIG. 12 is a side view of another exemplary suppressor assembly.

FIG. 12 is a side view of the suppressor assembly 200. In FIG. 12, same or similar components shown in FIGS. 1-11 include the same elements numbers as shown in FIGS. 1-11. In the exemplary embodiment, the inlet cap 202 is configured to receive a barrel end 204 of the firearm. The inlet cap 202 is removably coupled to the baffle assembly 102 via fasteners, such as but not limited to, threads. The outlet cap 105 is integrally coupled to the external fastener 132 of the baffle outlet end 123. In an embodiment, the baffle assembly 102 and the outlet cap 105 are formed from the same piece of material. The inner diameter of the ballistic pathway 114 of the inlet cap 202 is sized and shaped to slide over and around the barrel end 204 of the firearm barrel. In this "over-the-barrel" configuration, the cap body 206 has a different length than the cap body 112 of FIGS. 1-10. More particularly, the cap body 206 has a longer length than the cap body 112. The cap body 206 has a length as measured from the cap inlet end 108 and to the cap outlet end 110 from about 1 inch to about 10 inches; and preferably, about 5 inches.

By sliding over the firearm barrel, the suppressor assembly 200 extends outward from the firearm barrel at a lesser length as compared to the suppressor assembly 100 of FIG. 1. A smaller length can increase mobility in some hostile environments. The baffle assembly 102 includes the first plurality of openings 146 in the first alternating pattern 150. Moreover, the baffle assembly 102 includes the second plurality of openings 160 in the second alternating pattern 162. As illustrated in FIG. 11, within the baffle chamber 144 between the first baffle 143 and the plurality of baffles 142, there is at least one of the first opening 146 and second opening 160 defined through the body 125 and in flow communication with the ballistic pathway 114. The size and shape of the suppressor assembly 200 is configured to reduce noise and/or flash of the discharged firearm.

Figure 13:
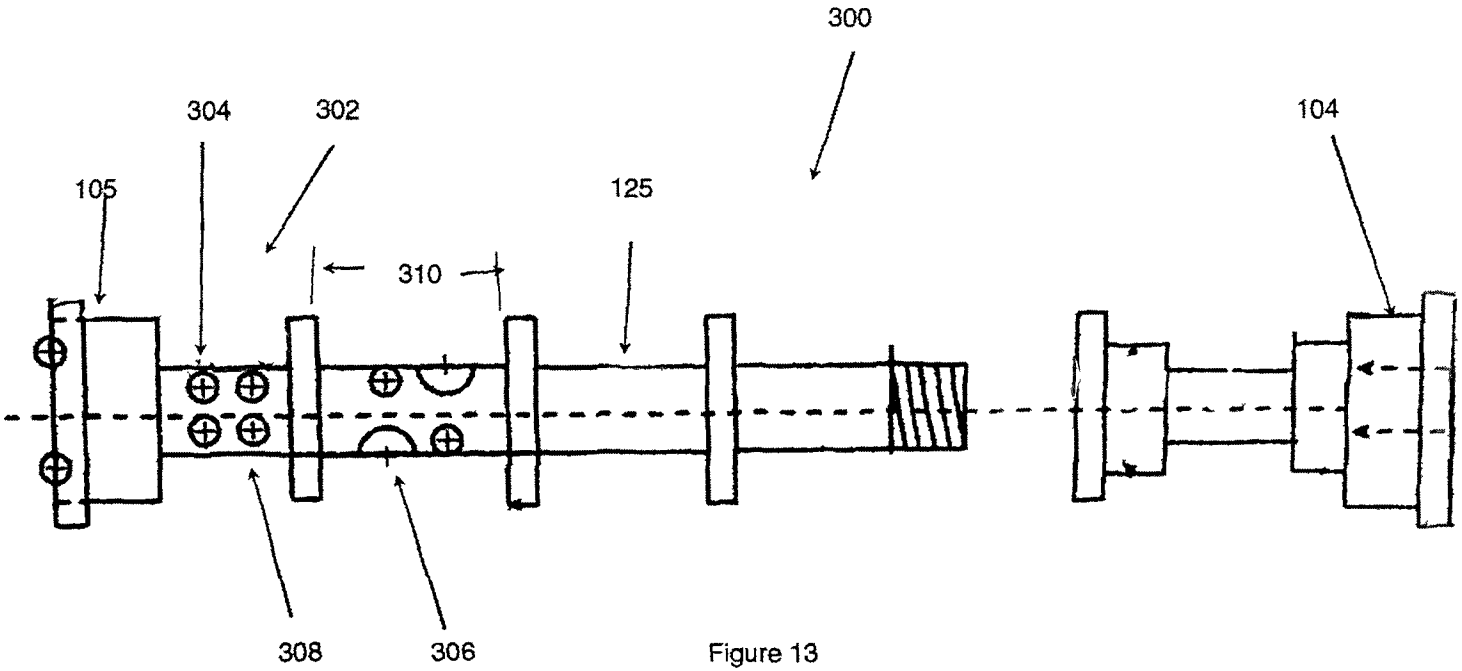
FIG. 13 is a side view of another exemplary suppressor assembly.

FIG. 13 is a side view of another suppressor assembly 300. In FIG. 13, same or similar components shown in FIGS. 1-12 include the same elements numbers as shown in FIGS. 1-12. In the exemplary embodiment, the baffle body 125 is removably coupled to the inlet cap 104 via, for example only, threads. The outlet cap 105 can be integrally coupled to the baffle body 125. A plurality of apertures 302, which is disposed through the body 125 and in flow communication with the ballistic pathway, include a first plurality of apertures 304 and a second plurality of apertures 306. The second plurality of apertures 306 include a different diameter size than the first plurality of apertures 304. More particularly, the second plurality of apertures 306 includes a larger diameter than the first plurality of apertures 304. In an embodiment, the first apertures 304 have a about ¼ inch diameter and the second apertures 306 have about a ⅜ inch diameter. Alternatively, the second plurality of apertures 306 can have a smaller diameter or the same size diameter than the first plurality of apertures 304. The sizes of the apertures 304, 306 facilitate dissipating the discharge gases that exit the muzzle of the firearm to reduce the level of noise and/or flash being emitted.

Moreover, the first plurality of apertures 304 is drilled through the side portion 131 and the other side portion 133 of the baffle body 125. Additionally, the first plurality of apertures 304 is positioned in a quadrant formation in the baffle chamber 308 adjacent to the outlet cap 105. The first apertures 304 are also positioned in the next adjacent baffle chamber 310. The second plurality of apertures 306 is milled into the upper portion 127 and the lower portion 129; and, positioned in the second baffle chamber 310. The positioning of the apertures 304, 306 facilitates dissipating the discharge gases that exit the muzzle of a firearm to reduce the level of noise and/or flash being emitted.

Figure 14:
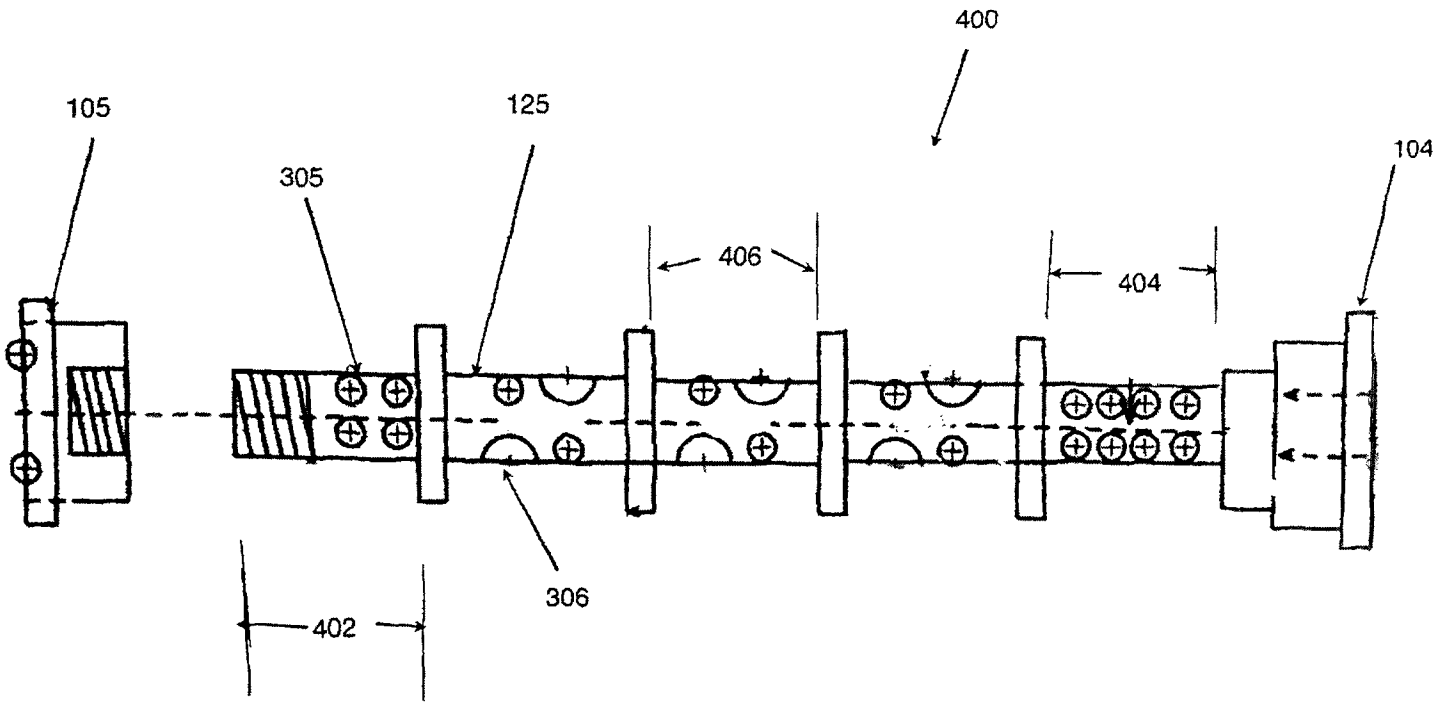
FIG. 14 is a side view of another exemplary suppressor assembly.

FIG. 14 is a side view of another suppressor assembly 300. In FIG. 13, same or similar components shown in FIGS. 1-12 include the same elements numbers as shown in FIGS. 1-12. In the exemplary embodiment, the baffle body 125 is removably coupled to the inlet cap 104 via, for example only, threads. The outlet cap 105 can be integrally coupled to the baffle body 125. A plurality of apertures 302, which is disposed through the body 125 and in flow communication with the ballistic pathway, include a first plurality of apertures 304 and a second plurality of apertures 306. The second plurality of apertures 306 includes a different diameter size than the first plurality of apertures 304. More particularly, the second plurality of apertures 306 includes a larger diameter than the first plurality of apertures 304. In an embodiment, the first apertures 304 have about ¼ inch diameter and the second apertures 306 have about a ⅜ inch diameter. Alternatively, the second plurality of apertures 306 can have a smaller diameter or the same size diameter than the first plurality of apertures 304. The sizes of the apertures 304, 306 facilitate dissipating the discharge gases that exit the muzzle of the firearm to reduce the level of noise and/or flash being emitted.

Moreover, the first plurality of apertures 304 is drilled through the side portion 131 and the other side portion 133 of the baffle body 125. Additionally, the first plurality of apertures 304 is positioned in a quadrant formation in the baffle chamber 308 adjacent to the outlet cap 105. The first apertures 304 are also positioned in the next adjacent baffle chamber 310. The second plurality of apertures 306 is milled into the upper portion 127 and the lower portion 129; and, positioned in the second baffle chamber 310. The positioning of the apertures 304, 306 facilitates dissipating the discharge gases that exit the muzzle of a firearm to reduce the level of noise and/or flash being emitted.

Exemplary embodiments of a noise suppressor are described herein. The methods and assemblies are not limited to the specific embodiments described herein, but rather, components of assemblies and/or steps of the methods may be utilized independently and separately from other components and/or steps described herein. For example, the methods may also be used in combination with other assemblies and methods, and are not limited to practice with only the assemblies and methods described herein. Rather, the exemplary embodiments may be implemented and utilized in connection with many other firearms.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention and also to enable any person skilled in the art to practice the invention, including making and using devices or assemblies or systems and performing any incorporated method. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A suppressor assembly for reducing noise created by a ballistic fired from a firearm muzzle, the suppressor assembly comprising:

an inlet cap comprising a cap inlet end, a cap outlet end, and a cap body extending therebetween, the cap inlet end includes an external fastener and includes an internal fastener;

a baffle assembly integrally coupled to the inlet cap, the baffle assembly comprises a baffle inlet end, a baffle outlet end, and a cylindrical body extending continuously therebetween wherein the cylindrical body comprises a plurality of first openings defined through the outer wall and the inner wall and in flow communication with the ballistic pathway, the plurality of first openings are sequentially arranged along the cylindrical body and in a first alternating pattern relative to a first side portion of the longitudinal axis and an opposing second side portion of the longitudinal axis and a plurality of second openings defined through the outer wall and the inner wall and in flow communication with the ballistic pathway, the plurality of second openings are sequentially arranged along the cylindrical body and in a second alternating pattern relative to an upper portion of the longitudinal axis and a lower portion of the longitudinal axis;

an outlet cap removably coupled to the baffle outlet end and comprising another cap inlet end, another cap outlet end, and another cap body extending therebetween, the cap outlet end includes another external fastener and includes another internal fastener; and a housing removably and pressurably coupled to the inlet cap and to the outlet cap, the housing comprises a housing inlet end, a housing outlet end, and a housing body extending therebetween, wherein the housing inlet end includes an internal housing fastener configured to removably and pressurably couple to the external fastener of the cap inlet end of the inlet cap and the housing outlet end includes another internal housing fastener configured to removably and pressurably couple to the other external fastener of the outlet cap.

2. The suppressor assembly of claim 1 wherein the internal fastener of the inlet cap is configured to removably couple to the firearm muzzle.

3. The suppressor assembly of claim 1 wherein the cylindrical body is configured to continuously extend between the baffle inlet end and the baffle outlet end, the body comprising an outer wall and an inner wall, the inner wall is configured to define a ballistic pathway about a longitudinal axis of the suppressor assembly.

4. The suppressor assembly of claim 3 further comprising a plurality of baffles coupled to the cylindrical body and radially extending outward from the body.

5. The suppressor assembly of claim 1 wherein each first opening of the plurality of first openings and each second opening of the plurality of second openings are positioned within a baffle chamber formed by the plurality of baffles.

6. A suppressor assembly for reducing noise created by a ballistic fired from a firearm muzzle, the suppressor assembly comprising:

an inlet cap comprising a cap inlet end, a cap outlet end, and a cap body extending therebetween;

a baffle integrally coupled to the cap outlet end, the baffle assembly comprises a baffle inlet end, a baffle outlet end, and a cylindrical body continuously extending therebetween and about a longitudinal axis of the baffle assembly, the cylindrical body comprising:

a plurality of first openings sequentially arranged along the cylindrical body and in a first alternating pattern relative to a first side portion and an opposing second side portion of the longitudinal axis; and a plurality of second openings sequentially arranged along the cylindrical body and in a second alternating pattern relative to an upper portion and a lower portion of the longitudinal axis;

an outlet cap removably coupled to the baffle outlet end; and a housing removably and pressurably coupled to the cap inlet end and to the baffle outlet end wherein the housing surrounds the cap body and the cylindrical body.

7. The suppressor assembly of claim 6 further comprising a cap outlet end removably and pressurably coupled to the housing outlet end.

* * * * *